US007513044B2

(12) United States Patent
Lake

(10) Patent No.: US 7,513,044 B2
(45) Date of Patent: Apr. 7, 2009

(54) FOLDING KNIFE WITH SPRING WEAR PIN

(76) Inventor: Ronald W. Lake, 3360 Bendix Ave., Eugene, OR (US) 97401

( * ) Notice: Subject to any disclaimer, the term of this patent is extended or adjusted under 35 U.S.C. 154(b) by 468 days.

(21) Appl. No.: 11/324,546

(22) Filed: Jan. 3, 2006

(65) Prior Publication Data

US 2006/0143929 A1 Jul. 6, 2006

Related U.S. Application Data

(60) Provisional application No. 60/640,249, filed on Jan. 3, 2005.

(51) Int. Cl.
*B26B 1/04* (2006.01)

(52) U.S. Cl. ..... 30/155; 30/161

(58) Field of Classification Search ..... 30/153, 30/155, 160, 161
See application file for complete search history.

(56) References Cited

U.S. PATENT DOCUMENTS

| | | | | |
|---|---|---|---|---|
| 1,365,487 | A | 1/1921 | Hallverson | |
| 1,512,689 | A * | 10/1924 | Hermann | 30/161 |
| 1,521,778 | A | 1/1925 | McLay | |
| 1,734,126 | A | 11/1929 | Guttzeit | |
| 4,896,424 | A | 1/1990 | Walker | |
| 5,546,662 | A * | 8/1996 | Seber et al. | 30/161 |
| 5,699,615 | A | 12/1997 | Chen | |
| 5,755,035 | A * | 5/1998 | Weatherly | 30/161 |
| 5,909,930 | A * | 6/1999 | Ragland, III et al. | 30/125 |
| 6,434,831 | B2 * | 8/2002 | Chen | 30/161 |
| 6,490,797 | B1 | 12/2002 | Lake | |
| 6,591,504 | B2 * | 7/2003 | Onion | 30/160 |
| 6,618,946 | B2 * | 9/2003 | Seraphin | 30/160 |
| 6,668,460 | B2 * | 12/2003 | Feng | 30/161 |
| 6,675,484 | B2 * | 1/2004 | McHenry et al. | 30/161 |
| 6,834,432 | B1 * | 12/2004 | Taylor, Jr. | 30/161 |
| 7,020,969 | B2 * | 4/2006 | Roberson | 30/161 |
| 7,080,457 | B2 * | 7/2006 | Sullivan | 30/160 |
| 7,305,768 | B2 * | 12/2007 | Hinderer | 30/161 |
| 2004/0244205 | A1 * | 12/2004 | Linn et al. | 30/160 |
| 2006/0162168 | A1 * | 7/2006 | Kao | 30/161 |
| 2006/0236549 | A1 * | 10/2006 | Martin | 30/161 |
| 2007/0151110 | A1 * | 7/2007 | Chen | 30/155 |
| 2007/0169354 | A1 * | 7/2007 | Ralph | 30/160 |
| 2007/0169355 | A1 * | 7/2007 | Lake | 30/160 |

FOREIGN PATENT DOCUMENTS

| | | | |
|---|---|---|---|
| EP | 750969 | A2 * | 1/1997 |
| JP | 09108456 | A * | 4/1997 |

* cited by examiner

*Primary Examiner*—Jason Daniel Prone
(74) *Attorney, Agent, or Firm*—Teri G. Andrews

(57) ABSTRACT

The handle of a folding knife has an integral spring biased portion that is biased toward the blade disposed in the center of the handle. The spring biased portion locks the blade in the open position by sliding under the rear of the blade when the knife blade is rotated to the fully open position. This same spring biased portion also locks the blade in the closed position by engaging in a recess in the side of the tang of the blade when the blade is rotated to the closed position. Preferably, the spring biased portion also employs a replaceable wear pin that makes all contact with the blade when rotating between the open and closed positions thereby eliminating the wear on the spring biased portion of the handle which is typically made from a soft, biasable material such as aluminum, zinc, or plastic.

18 Claims, 2 Drawing Sheets

FOLDING KNIFE WITH SPRING WEAR PIN

CROSS-REFERENCE TO RELATED APPLICATIONS

This application claims priority under 35 U.S.C. §119(e) to U.S. Provisional Application Ser. No. 60/640,249 entitled "Folding Knife with Spring Wear Pin," filed on Jan. 3, 2005, the entire disclosure of which is herein incorporated by reference for all purposes.

BACKGROUND OF THE INVENTION

1. Field of the Invention

This invention relates to a folding knife and, more particularly, to an improved locking mechanism for a folding knife.

2. Prior Art

It is common practice for folding knives to have locking mechanisms. The locking mechanism is necessary to keep the knife firmly in the open position when in use and to keep it from inadvertently opening when intended to be closed. Most locking mechanisms use a spring element, or spring biased element, moving in the plane of the knife as a locking element. U.S. Pat. No. 1,365,487 granted to Hallverson and U.S. Pat. No. 1,734,126 granted to Guttzeit are examples.

Another type of known locking mechanism moves laterally to the plane of the knife. Examples include: U.S. Pat. No. 1,521,778 granted to McLay; U.S. Pat. No. 4,896,424 granted to Walker; and U.S. Pat. No. 5,699,615 granted to Chen. McLay provides a three-piece side panel, one piece of which is a spring-biased lever having a locking flange at one end. The flange is moved into and out of apertures in the tang of the blade to effect locking. Such movement is produced by a plate on the opposite end of the lever. Inadvertent squeezing of the plate could cause closure of the blade, perhaps on the fingers of the user. Walker and Chen both provide a deflectable spring lock internal to the knife handle. Both also require an extra element for the locking mechanism in addition to their side panels. And, in each, the tip of the spring contacts directly with the blade to effect locking.

An improvement over the aforementioned prior art is the locking mechanism disclosed in U.S. Pat. No. 6,490,797 granted to Lake, the present inventor. The mechanism in Lake is a blade lock wherein the spring which biases the lock into locking engagement with the blade is a part of one of the side panels of the folding knife. This blade lock is a replaceably mounted, wear resistant disc coacting with a conical recess provided in the end face of the blade so that as the disc wears, it maintains an efficacious lock merely by seating deeper into the recess. Although Lake is a significant improvement over the prior art, manufacturing of the coacting disc and conical recess requires a level of precision that makes it costly to produce.

There is a need for a folding knife that is safe, wear resistant, and simplistic in design; therefore, inexpensive to manufacture.

OBJECTS AND ADVANTAGES OF THE PRESENT INVENTION

It is a primary object of the present invention to provide a blade lock for a folding knife that greatly reduces manufacturing costs and improves performance of folding knives.

It is an another object of the present invention to provide a more robust folding knife with an integral locking mechanism from inexpensive, lightweight materials while maintaining the durability expected from the folding knives of the current technologies.

It is a further object of the present invention to provide a blade lock for a folding knife that has a spring locking mechanism that utilizes a wear pin that can be made from hardened or wear resistant materials, is replaceable, and easily varied in size to adjust for errors in machining during manufacture.

SUMMARY OF THE INVENTION

A folding knife has a handle that has a spring biased portion that is biased toward the center of the handle. The folding knife has a blade that has a tang at one end and is pivotally attached to the handle at the tang. There is a wear pin disposed in the end of the spring biased portion of the handle. When the blade is pivoted to an open position, the wear pin slides under the end of the tang of the blade and locks the blade in the open position. When the spring biased portion is released from under the end of the tang and the blade is pivoted to a closed position, the wear pin is springably disposed into a recess in the tang thereby locking the blade in the closed position.

BRIEF DESCRIPTION OF THE DRAWINGS

The above description and other objects, advantages, and features of the present invention will be more fully understood and appreciated by reference to the specification and accompanying drawings, wherein.

DRAWINGS

Reference Numerals

10 Folding Knife
11 Blade Tip
12 Blade
13 First Handle Side
14 Spring Locking Portion
15 Spring Slot
16 Pivot Bolt
17 Tang Portion
18 Overbend Screw
20 Wear Pin
22 Wear Pin Recess
24 Thumb Notch
26 Spring Inner Edge
27 Spring End
28 Spring Outer Edge
32 Wear Pin Protruding Portion
34 Washer

36 Second Handle Side

38 Tang Base

DETAILED DISCUSSION OF THE PREFERRED EMBODIMENTS

Referring to the figures, like elements retain their indicators throughout the several views.

Figure 1:
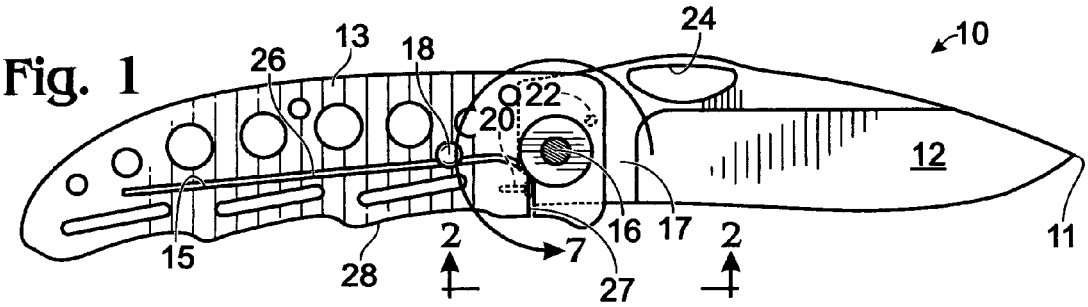
FIG. 1 is a side view of the preferred embodiment of the folding knife of the present invention in the locked open position.

FIG. 1 is a side view of the preferred embodiment of Folding Knife 10 of the present invention with Folding Knife 10 in the locked open position. Folding Knife 10 has a Blade 12 pivotally attached by Pivot Bolt 16 and dispensed between First Handle Side 13 and Second Handle Side 36 (not shown). Blade 12 has a Blade Tip 11 at one end and a Tang Portion 17 at the opposite end. Pivot Bolt 16 extends through First Handle Side 13, Tang Portion 17 of Blade 12, and through Second Handle Side 36 (not shown).

Spring Locking Portion 14 is an integral part of First Handle Side 13 and is partially separated from First Handle Side 13 by Spring Slot 15. First Handle Side 13 and Second Handle Side 36 (not shown) are preferably aluminum, but can also be machined or cast from other lightweight materials such as zinc or plastic. Spring Locking Portion 14 has a Spring Inner Edge 26, a Spring Outer Edge 28, and a Spring End 27. Wear Pin 20 (partially shown in phantom) is disposed in Spring Locking Portion 14 at Spring End 27. Wear Pin 20 can be pressed, threaded, or staked into Spring End 27. Wear Pin 20 makes contact with and rides along an angled ramp on Tang Portion 17 of Blade 12 as it is opened and closed.

In the preferred embodiment, Thumb Notch 24 is shown as a cut out or hole in Blade 12 that is utilized for opening or unfolding Folding Knife 10. The user slightly inserts their thumb to release Blade 12 thereby opening Folding Knife 10. It has been contemplated that Thumb Notch 24 can be a slight recess or any other cut out feature that enables a thumb to grip Blade 12 for opening purposes.

Overbend Screw 18 extends through First Handle Side 13. The head of Overbend Screw 18 spans over Spring Slot 15 and over Spring Inner Edge 26 covering a small area of Spring Locking Portion 14 thereby not allowing Spring Locking Portion 14 to overextend above the plane of First Handle Side 13. In the alternative and as shown in Fig 1, Pivot Bolt 16 can be made large enough that it spans across Spring Slot 15 and covers a small area of Spring End 27 which also keeps Spring Locking Portion 14 from moving above the plane of First Handle Side 13. Although FIG. 1 shows both an enlarged Pivot Bolt 16 and Overbend Screw 18 to avoid overextension of Spring Locking Portion 14, it is contemplated that either will work satisfactorily in the absence of the other.

Wear Pin Recess 22 (shown in phantom) is a slight concavity in the Tang Portion 17 of Blade 12 and will be discussed in greater detail hereinafter.

Figure 2:
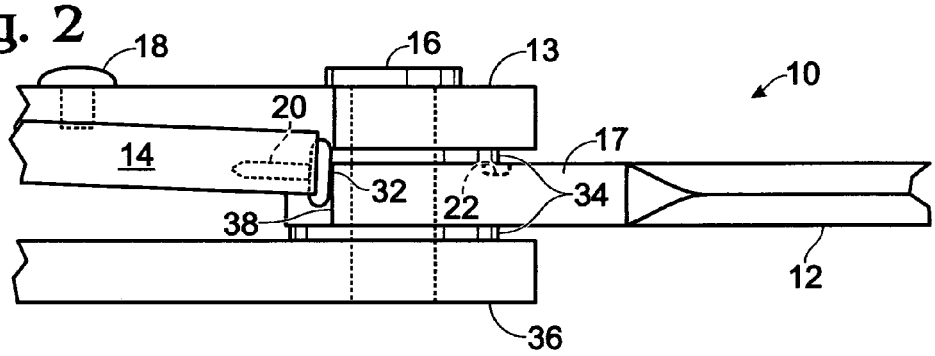
FIG. 2 is a bottom view of the preferred embodiment of the folding knife of the present invention in the fully open position taken along line 2-2 of FIG. 1.

FIG. 2 is a bottom view of the preferred embodiment of Folding Knife 10 of the present invention with Folding Knife 10 in the fully open position taken along line 2-2 of FIG. 1. First Handle Side 13, Second Handle Side 36, and Blade 12 are in parallel with one another and slightly separated by Washers 34. In FIG. 2 with Folding Knife 10 in the open position, the spring force of Spring Locking Portion 14 biases it toward Second Handle Side 36 thereby lodging Wear Pin Protruding Portion 32 of Spring Locking Portion 14 under Tang Base 38 and locking Blade 12 into the open position. Overbend Screw 18 is shown screwed into First Handle Side 13.

As illustrated in FIG. 2, Wear Pin Recess 22 is approximately opposite Wear Pin Protruding Portion 32 of Spring Locking Portion 14 with respect to Pivot Bolt 16. When the user opens Folding Knife 10, Blade 12 rotates approximately 180 degrees before Spring Locking Portion 14 springably seats itself under Tang Base 38 thereby locking Folding Knife 10 in the open position.

Figure 3:
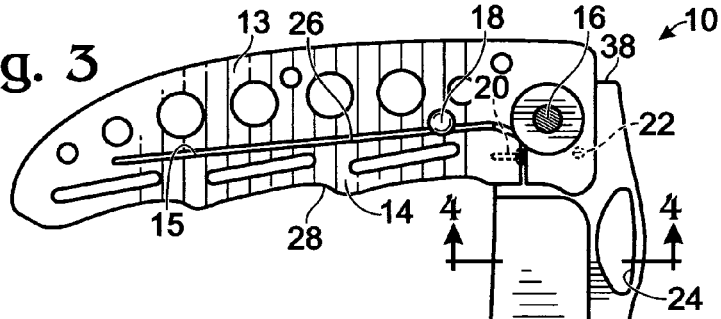
FIG. 3 is a side view of the preferred embodiment of the folding knife of the present invention in the half open position.

FIG. 3 is a side view of the preferred embodiment of Folding Knife 10 of the present invention in the half open position. To initiate closure of Folding Knife 10, Spring Locking Portion 14 is contacted on Spring Outer Edge 28 by a user's thumb and raised to a level substantially planer with First Handle Side 13 thereby dislodging Wear Pin Protruding Portion 32 from under Tang Base 38 allowing Blade 12 to rotate toward the closed position.

Figure 4:
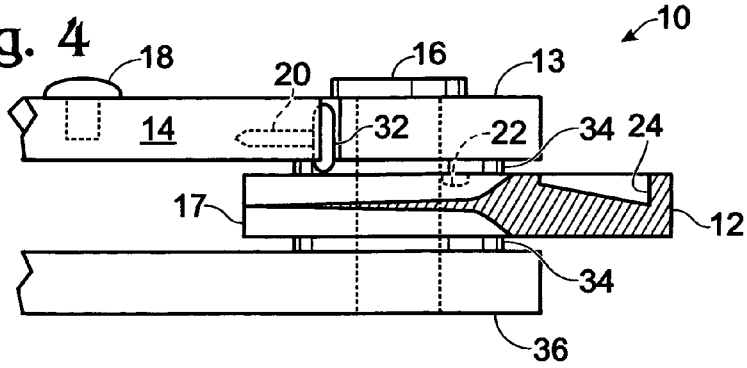
FIG. 4 is a bottom view of the preferred embodiment of the folding knife of the present invention in the half open position taken along line 4-4 of FIG. 3.

FIG. 4 is a bottom view of the preferred embodiment of Folding Knife 10 of the present invention with Folding Knife 10 in the half open position taken along line 4-4 of FIG. 3. Spring Locking Portion 14 has been expanded to a position substantially parallel to First Handle Side 13 allowing Tang Portion 17 of Blade 12 to rotate past Wear Pin Protruding Portion 32 of Spring Locking Portion 14. FIG. 4 illustrates Wear Pin Protruding Portion 32 sliding along Tang Portion 17 as Blade 12 is being rotated toward the closed position of Folding Knife 10.

With Spring Locking Portion 14 biased toward the center of Folding Knife 10 the spring biasing causes it to ride against Tang Portion 17 during opening and closing. The ability to use aluminum or other soft, lightweight, biasable materials for the outer handle portions of Folding Knife 10 allows Spring Locking Portion 14 to be an integral part of the handle rather than an additional piece. However, knife blades are typically made from steel or other hard materials for durability and strength. In the absence of Wear Pin Protruding Portion 32 of Wear Pin 20, the steel of Blade 10 will quickly wear down the soft, lightweight material of Spring End 27 of Spring Locking Portion 14 making the locking feature of Folding Knife 10 prematurely unreliable or possibly nonfunctioning. When Wear Pin 20 fatigues or wears out it can be easily replaced and extending the life of Folding Knife 10.

Figure 5:
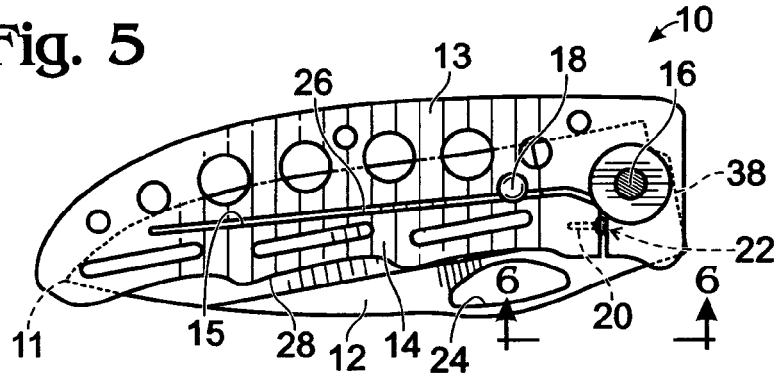
FIG. 5 is a side view of the preferred embodiment of the folding knife of the present invention in the closed position.

FIG. 5 is a side view of the preferred embodiment of the Folding Knife 10 of the present invention with Folding Knife 10 in the closed position. As can be seen in FIG. 5, Blade 12 (partially shown in phantom) has swept through approximately 180 degrees to return to the closed position where it is disposed between First Handle Side 13 and Second Handle Side 36 (not shown).

Figure 6:
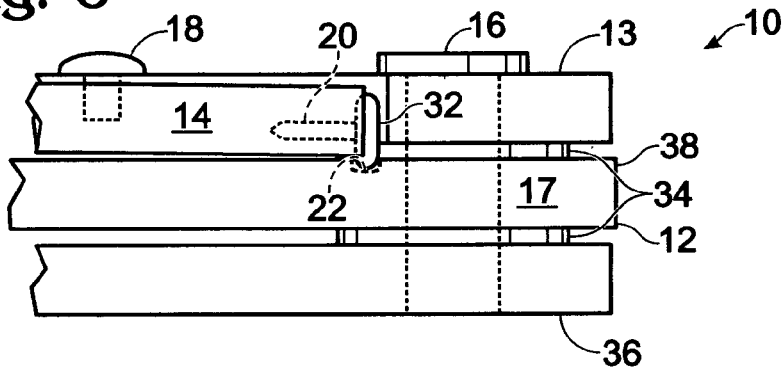
FIG. 6 is a bottom view of the preferred embodiment of the folding knife of the present invention in the closed position taken along line 6-6 of FIG. 5.

FIG. 6 is a bottom view of the preferred embodiment of Folding Knife 10 of the present invention with Folding Knife 10 in the closed position taken along line 6-6 of FIG. 5. In this closed position, Wear Pin Protruding Portion 32 of Wear Pin 20 is springably seated into Wear Pin Recess 22. This seating, although fairly shallow, keeps Folding Knife 10 in the proper closed position. The spring biasing of Spring Locking Portion 14 applies adequate pressure to maintain this closed position. However, this spring pressure is easily overcome with the pressure of the user's thumb in Thumb Notch 24 (see FIG. 5) rotating Blade 12 away from First Handle Side 13 to open Folding Knife 10 for use without the need to expand Spring Locking Portion 14.

Figure 7:
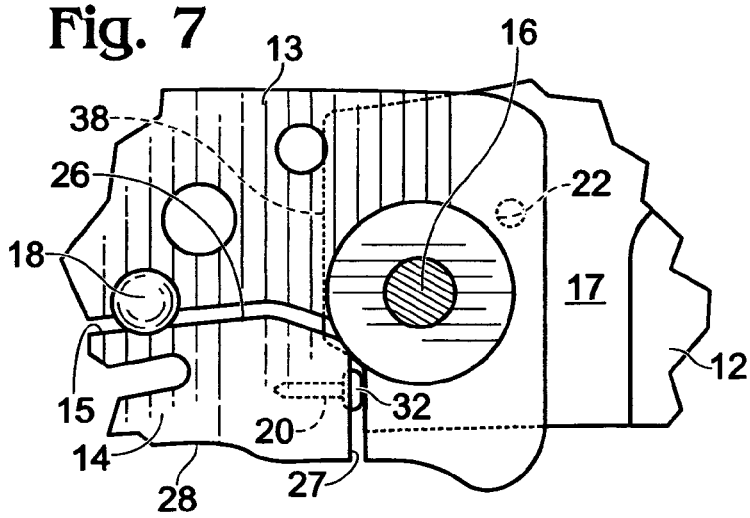
FIG. 7 is an enlarged side view of the preferred embodiment of the folding knife of the present invention in the open position depicted by line 7 of FIG. 1.

FIG. 7 is an enlarged side view of the preferred embodiment of Folding Knife 10 of the present invention depicted by line 7 of FIG. 1 with Folding Knife 10 in the open position. As previously discussed and shown in detail in FIG. 7, Wear Pin Recess 22 is approximately opposite Wear Pin Protruding Portion 32 of Spring Locking Portion 14 with respect to Pivot Bolt 16. When Folding Knife 10 is opened, Blade 12 rotates approximately 180 degrees before Spring Locking Portion 14 springably seats itself under Tang Base 38 thereby locking Folding Knife 10 in the open position.

Wear Pin 20 can be constructed of any hardened or wear resistant material. Wear Pin 20 can be pressed, threaded or staked into Spring End 27 where Wear Pin Protruding Portion 32 makes contact with Tang Portion 17 of Blade 12. As Wear Pin Protruding Portion 32 has a slight radius, Wear Pin Recess 22 can be a hole or a small, somewhat circular recess in Tang Portion 17. When Wear Pin Protruding Portion 32 makes contact with the edge of Wear Pin Recess 22, the spring pressure pulls Blade 12 into the proper closed position.

Additionally, Pivot Bolt 16 is shown spanning Spring Slot 15 and extending slightly over Spring Inner Edge 26 thereby disallowing over-expansion of Spring Locking Portion 14. In a similar manner, Overbend Screw 18 is also shown spanning Spring Slot 15 and extending slightly over Spring Inner Edge 26. As previously discussed, either Pivot Bolt 16 or Overbend Screw 18 alone will function to eliminate the possibility of over-extending Spring Locking Portion 14 and potentially breaking it off from First Handle Side 13 or destroying the spring capability of Spring Locking Portion 14. This spring capability is what keeps Spring Locking Portion 14 biased toward Second Handle Side 36 creating both the locking open and the locking closed function of Blade 12. It has also been contemplated that for cast or molded handles this overbend feature can be designed into the cast or mold.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A folding knife comprising:

a blade having a tip, a tang portion, the tang portion having an end opposite the tip and a tang side surface, the tang side surface having a recess;

a first handle side being bifurcated by a longitudinally extended slot into a first portion and a spring locking portion, the slot having an open end and a closed end opposite the open end, the spring locking portion of the first handle side having a spring locking end adjacent to the open end of the slot and a wear pin disposed in the spring locking end, the wear pin extending beyond the spring locking end and slightly below a plane of the spring locking portion and toward the blade, when closed the wear pin springably slides into the recess of the tank thereby maintain the closed position, and when the blade of the folding knife is rotated to the open position, the wear pin slides under the end of the tank thereby locking the blade in the open position;

a second handle side; and a pivot bolt extending through the first portion of the first handle side proximate the open end of the slot, through the tang portion of the blade, and through the second handle side allowing the blade to pivot at the tang portion, the blade is parallel to the first handle side and the second handle side;

wherein the spring locking portion is biased toward the blade such that when the blade is rotated to a closed position, the spring locking portion is springably disposed in the recess of the tang, and to open the folding knife, the blade is rotated such that the spring locking end springably slides under the end of the tang thereby locking the blade in an open position.

2. The folding knife of claim 1, wherein the first handle side and the second handle side are made of aluminum.

3. The folding knife of claim 1, wherein the first handle side and the second handle side are made of zinc.

4. The folding knife of claim 1, wherein the first handle side and the second handle side are made of plastic.

5. The folding knife of claim 1, wherein the recess in the tang of the blade is a hole.

6. The folding knife of claim 1, wherein the recess in the tang of the blade is a substantially round concavity.

7. The folding knife of claim 1, further comprising an overbend screw disposed in the first portion of the first handle side, the overbend screw having a screw head extending across the slot and a portion of the spring locking portion of the first handle side thereby not allowing the spring locking portion to extend above the plane of the first portion.

8. The folding knife of claim 1, wherein the pivot bolt further comprises a bolt head that extends across the slot and a portion of the spring locking portion of the first handle side thereby not allowing the spring locking portion to extend above the plane of the first portion.

9. The folding knife of claim 1, wherein the wear pin is replaceable.

10. A folding knife, comprising:

a handle having a length and a slot disposed the length of the handle and open at a distal end, a portion of the handle on a first side of the slot is a handle side having a side bifurcated slot open proximate the distal end of the handle, in communication with the slot and the side slot is a spring locking portion that is biased toward the center of the slot and having a spring end proximate the distal end of the handle;

a blade disposed within the slot of the handle having a tang at one end and pivotally attached by a pivot bolt at the distal end of the handle at the tang, the tang having a tang end and a tang side, the tang side having a tang recess; and a wear pin is disposed in the spring end of spring locking portion of the handle;

wherein when the blade is pivoted to an open position the wear pin of the spring locking portion springably slides under the tang end of the blade thereby locking the blade in the open position, and when the spring locking portion is released from under the tang end and the blade is pivoted to a closed position thereby disposing the blade within the handle, the wear pin is springably disposed into the tang recess thereby locking the blade in the closed position.

11. The folding knife of claim 10, wherein the handle is made of aluminum.

12. The folding knife of claim 10, wherein the handle is made of zinc.

13. The folding knife of claim 10, wherein the handle is made of plastic.

14. The folding knife of claim 10, wherein the tang recess is a hole.

15. The folding knife of claim 10, wherein the tang recess is a substantially round concavity.

16. The folding knife of claim 10, further comprising an overbend screw disposed in the handle side, the overbend screw having a screw head extending across the side slot to the spring locking portion thereby not allowing the spring locking portion to extend above a plane of the handle side.

17. The folding knife of claim 10, wherein the pivot bolt further comprises a bolt head that extends across the side slot and a portion of the spring locking portion thereby not allowing the spring locking portion to extend above a plane of the handle side.

18. The folding knife of claim 10, wherein the wear pin is replaceable.

* * * * *